US007243576B2

(12) United States Patent
Okabe

(10) Patent No.: US 7,243,576 B2
(45) Date of Patent: Jul. 17, 2007

(54) METHOD FOR MANUFACTURING AN INNER CUTTER OF A RECIPROCATING ELECTRIC SHAVER AND AN INNER CUTTER OF A RECIPROCATING ELECTRIC SHAVER

(75) Inventor: Masaki Okabe, Matsumoto (JP)

(73) Assignee: Izumi Products Company, Nagano (JP)

( * ) Notice: Subject to any disclaimer, the term of this patent is extended or adjusted under 35 U.S.C. 154(b) by 83 days.

(21) Appl. No.: 11/036,008

(22) Filed: Jan. 14, 2005

(65) Prior Publication Data

US 2005/0155230 A1 Jul. 21, 2005

(30) Foreign Application Priority Data

Jan. 15, 2004 (JP) ..... 2004-007505

(51) Int. Cl.
*B21K 11/00* (2006.01)
*B26B 19/04* (2006.01)

(52) U.S. Cl. ..... 76/104.1; 30/346.51; 72/335; 72/340

(58) Field of Classification Search ..... 30/43.9, 30/43.92; 76/104.1, 116; 29/418; 148/527; 72/335, 340
See application file for complete search history.

(56) References Cited

U.S. PATENT DOCUMENTS 3,858,461 A 1/1975 Tolmie
5,214,833 A * 6/1993 Yada ..... 29/418
7,022,195 B2 * 4/2006 Otani et al. ..... 148/527
2005/0199096 A1 * 9/2005 Okabe ..... 76/104.1
2006/0021234 A1 * 2/2006 Yanosaka et al. ..... 30/346.51

FOREIGN PATENT DOCUMENTS

GB 775 078 5/1957
JP 62-148684 7/1987

* cited by examiner

*Primary Examiner*—Hwei-Siu Payer
(74) *Attorney, Agent, or Firm*—Koda & Androlia

(57) ABSTRACT

A method for manufacturing an inner cutter for a reciprocating electric shaver, including the steps of: press-stamping a thin metal plate to obtain a thin metal plate element that has an outer contour of an unfolded inner cutter and elongated openings that extend substantially perpendicular to the direction of the reciprocating motion the inner cutter makes and further has bridging-portions formed between the elongated openings; pressing the bridging-portions so that each bridging-portion has a final sectional shape of each cutter blade of the inner cutter; twisting the bridging-portions so that the cutter surfaces of the cutter blades are aligned substantially to the surface of the thin metal plate element; forming the thin metal plate element into substantially an arch shape with the cutter surface sides of the cutter blades facing outward; and executing finishing-work on the outer circumferential surface of the arch-shaped thin metal plate element.

8 Claims, 8 Drawing Sheets

METHOD FOR MANUFACTURING AN INNER CUTTER OF A RECIPROCATING ELECTRIC SHAVER AND AN INNER CUTTER OF A RECIPROCATING ELECTRIC SHAVER

BACKGROUND OF THE INVENTION

1. Technical Field

The present invention relates to a method for manufacturing an inner cutter for a reciprocating electric shaver in which an inner cutter makes reciprocating motions while making sliding contact with the inside surface of an arch-shaped outer cutter and further relates to such an inner cutter.

2. Description of the Related Art

In a typical reciprocating electric shaver, the inner cutter is caused to make a reciprocating motion while making sliding contact with the inside surface of an arch-shaped outer cutter, thus cutting by the inner cutter hair that advances into the apertures formed in the outer cutter. Such inner cutters include an assembled inner cutter and an integral inner cutter as disclosed in Japanese Patent Application Laid-Open (Kokai) No. S62-148684.

In the assembled inner cutter, a plurality of cutter blades formed by stamping a thin metal plate into an arch shape are lined up at fixed intervals and held on a retaining base. In such an inner cutter, it is necessary to form a plurality of cutter blades and attach these cutter blades to a cutter blade attachment member. Accordingly, it requires increased numbers of manufacturing steps, and the problem is its poor productivity.

To the contrary, the integral inner cutter is a cutter in which all of the cutter blades are integrated. FIGS. 7 and 8 are perspective of such conventional integral inner cutters.

In the inner cutter 10 shown in FIG. 7, a plurality of arch-shaped cutter blades 14 are formed parallel to each other at fixed intervals by slits 12 that are opened in a hollow cylindrical body of a metal, ceramic, etc. (hereafter collectively called a "metal" in the present application) so that the slits 12 are substantially perpendicular to the axis of the hollow cylindrical body. The inner cutter 16 of FIG. 8 includes a plurality of arch-shaped cutter blades 20 that are parallel to each other at fixed intervals, and these cutter blades 20 are obtained by bending a flat metal plate into substantially an arch shape and by forming slits 18 that cut across the ridge line of the arch-shaped metal plate.

Of the above-described inner cutters, the inner cutter 10 shown in FIG. 7 is obtained by groove-cutting that is done by, as shown in FIG. 9, moving a circular cutting tool 200, which is rotated as shown by two-head curved arrow, in the direction perpendicular to the axis of a metallic hollow cylindrical body 10A as shown by two-head straight arrow, thus forming the slits 12. On the other hand, in the arch-shaped inner cutter 16 shown in FIG. 8, a thin metal plate formed with cutter blades 20 is used instead of the hollow cylindrical body 10A and bent into an arch shape.

However, in the method that uses a rotating cutting tool 200 as shown in FIG. 9, the cutter blades 14 (20) take the sectional shape as shown in FIG. 10. FIG. 10 is a sectional view of the inner cutter 10 (16) in a perpendicular section that includes the ridge line (and the centerline in the direction of the reciprocating motion of the inner cutter). In the cutter blades 14 (20) in FIG. 10, the rake angle θ which is the angle formed between the top surface (cutter surface) 22 and the end surfaces 24 directly beneath the top surface 22 of each cutter blade 14 (20) is 90°.

The top surfaces 22 of these cutter blades 14 (20) make a reciprocating motion while making sliding contact with the inside surface of an arch-shaped outer cutter 26 and thus cut hair that enters through apertures formed in the outer cutter 26. Accordingly, it is desirable that the rake angle θ be as sharp as possible; in other words, it is desirable that the rake angle θ be an acute angle that is less than 90°.

In order to form the rake angle θ into an acute angle, the outer end surfaces 24 of the cutter blades 14 (20) are ground or polished (hereafter collectively referred to simply as "grinding" in some cases) using a grindstone 28 or 30 as shown in FIG. 11. The grindstone 28 of a disk-form or rod-form grindstone is inserted into the spaces (slits 12 (18)) between the arch-shaped cutter blades 14 (20) and rotated as shown by two-head curved arrow and moved. The grindstone 30, on the other hand, has a tip end of a knob shape, and grinding is performed by rotating as shown by circular arrow and moving this knob-shaped tip end while pressing the knob-shaped tip end against the end surfaces 24.

FIG. 12 shows another way to form an acute rake angle in cutter blades. In the method of FIG. 12, grinding is performed by a circular grindstone 32 which is thicker than the width of the slits 18 of the arch-shaped inner cutter 16 and whose circumferential edge protrudes in the form of an acute angle; and such a circular grindstone 32 is caused to advance into the slits 18 from the inside of the inner cutter 16 while being rotated. This method is disclosed in Japanese Patent Application Laid-Open (Kokai) No. S53-116961. In FIG. 12, the reference numeral 34 is a centerline of the rotation of the grindstone 32.

In the inner cutters 10 and 16 made by the methods illustrated in FIGS. 7 through 9, since a thin metal plate or a metallic hollow cylindrical body with a certain thickness is used, the thickness of the cutter blades 14 and 20 (i.e., the thickness in the radial direction) is the same as the thickness of the thin metal plate or of the hollow cylindrical body. Ordinarily, it is necessary to reduce the weight of the inner cutter in order to reduce the driving force of the driving motor of a shaver and thus to reduce the consumption of energy; furthermore, it is desirable to avoid a thin metal plate or a hollow cylindrical body that has an excessive thickness in order to improve the grindability.

On the other hand, if a thin metal plate or a hollow cylindrical body of a small thickness is used, then the strength of the cutter blades becomes insufficient, and the inner cutter is caused to flex repeatedly together with the outer cutter by the pressure that is applied to the outer cutter during shaving. Further, the cutter blades undergo metal fatigue as a result of deformations, sagging of the cutter tips occurs, and the problem of deterioration in sharpness arises. Though inner cutters in which resin molded parts used for reinforcement are attached to compensate for the insufficient strength exist, the number of parts increases in such inner cutters, and the weight of the reciprocating portion also increases.

The method in which, as shown in FIG. 11, the end surfaces of the arch-shaped cutter blades 14 (20) are ground by causing the grindstone 28 or 30 to advance into the slits 12 (18) from the outside to make the rake angle θ of the cutter blades in acute angles requires extremely fine work, and thus it requires long working time. As a result, the working efficiency is poor, and the problem of productivity drop and manufacturing yield arises.

Furthermore, in the method that uses a rotating grindstone 32 as shown in FIG. 12, the grindstone 32 is caused to advance into the slits 18 from the inside of the arch-shaped inner cutter 16. Accordingly, the grindstone 32 needs to have an extremely small diameter. However, small diameter grindstones tend to easily wear out in a short period of time, and it is necessary to frequently replace the grindstones. As a result, in the method shown in FIG. 11, the working efficiency is poor, and the problem of a high manufacturing cost arises.

BRIEF SUMMARY OF THE INVENTION

The present invention is made in view of the facts described above.

It is a first object of the present invention to provide an inner cutter manufacturing method of a reciprocating electric shaver in which the cutter blades have sufficient strength without using thin metal plates of a large thickness, the weight of the inner cutter is low, the productivity is good, and the cutter blades have an acute rake angle.

It is a second object of the present invention to provide an inner cutter that is manufactured by such a method.

The above-described first object is accomplished by unique steps of the present invention for a method for manufacturing an inner cutter for a reciprocating electric shaver in which the inner cutter is caused to make a reciprocating motion while a plurality of arch-shaped cutter blades disposed on the inner cutter make sliding contact with the inside surface of an arch-shaped outer cutter, and in the present invention, the method comprises the steps of:

(a) press-stamping a thin metal plate to obtain a thin metal plate element that has an outer contour of an unfolded shape of the inner cutter and a plurality of elongated openings that extend substantially perpendicular to the direction of the reciprocating motion of the inner cutter, thus forming a plurality of bridging-portions between the elongated openings;

(b) pressing or press-working the bridging-portions of the press-stamped thin metal plate element so that each of the bridging-portions has a final sectional shape of each of the cutter blades in a direction substantially parallel to the surface of said thin metal plate element, (c) twisting the bridging-portions worked in the above-described press-working step (b) so that the cutter surfaces of the cutter blades are aligned substantially to the surface of the thin metal plate element, (d) forming the thin metal plate element, by for instance drawing, into substantially an arch shape with the cutter surface sides of the cutter blades facing outward, and (e) executing finishing-work on the outer circumferential surface of the arch-shaped thin metal plate element.

The above-described second object is accomplished by a unique structure of the present invention for an inner cutter for a reciprocating electric shaver in which the inner cutter comprises a plurality of arch-shaped cutter blades formed integrally therein so that the inner cutter makes a reciprocating motion while causing the cutter blades to make sliding contact with the inside surface of an arch-shaped outer cutter, and in the present invention, the width of the cutter blades in the radial direction is set to be greater than the thickness of edge portions that are on both sides of the inner cutter and parallel to the direction of the reciprocating motion of the inner cutter, and twisted portions are formed by twisting connecting portions that are between the cutter blades and the edge portions.

In the method of the present invention, the bridging-portions of a press-stamped thin metal plate element that form the cutter blades are worked by press so as to form substantially the final sectional shape of the cutter blades, and such bridging-portions are twisted so that the cutter blades are formed or raised. Accordingly, the width of the cutter blades (i.e., the width in the radial direction) is greater than the thickness of the thin metal plate element without using thick metal plates, the strength of the cutter blades is high, and the inner cutter can be light in weight. Furthermore, since all of the cutter blades are worked all together at the same time the press-working, etc. is performed, there is no need to cut out cutter blades one at a time from a metal plate. Accordingly, the productivity of the inner cutter is good. Moreover, the rake angle of the cutter blades can easily be worked simultaneously in the press-working step that is performed when the bridging-portions of the thin metal plate element are pressed into the final sectional shape of the cutter blades; accordingly, the rake angle can be formed in an acute angle easily.

The inner of the present invention is manufactured by the method described above. In the inner cutter for the present invention, since the width of the cutter blades in the radial direction is greater than the thickness of the thin metal plate element, the strength of the cutter blades with respect to a load applied in the radial direction is high. Moreover, since the inner cutter has twisted portions that are bent by twisting the connecting portions between the cutter blades and the edge portions on both sides of the inner cutter, the strength of the inner cutter as a whole is high, and the inner cutter is light in weight due to the use of a thin metal plate.

In the manufacturing method of the present invention, the final sectional shape of the cutter blades can be formed in step (b) into a shape in which the rake angle of the cutter blades is an acute angle, and thus the rake angle of an acute angle can be easily obtained. Since the width of the cutter blades worked in step (b) can easily be made larger than the thickness of the element, the cutter blades have sufficient rigidity, and the cutter blades have increased strength.

In the method of the present invention, cuts can be formed in the vicinity of the edges of the bridging-portions in step (b), and these cuts can be arranged in step (d) to form cut-outs that open inwardly or toward the inside between the inner circumferential edges and side edge portions of the cutter blades that are worked into substantially an arch shape. In the resulted inner cutter, the transmission of vibration between the cutter blades and the side edge portions is suppressed, and the sound quality during the use of the electric shaver can be improved.

By twisting the bridging-portions approximately 90° in step (c), the respective cutter blades are substantially perpendicular to the outer cutter, so that the strength of the cutter blades with respect to external forces applied to the outer cutter increases. However, this twisting angle need not be 90°, and the directions in which adjacent cutter blades are twisted can be opposite. Furthermore, it is preferable that the finishing work in step (e) is grinding of the outer circumferential surface of the cutter blades that is done by grindstones following quenching of the thin metal plate element. By way of performing grinding after quenching, the grindstone tends not to become clogged or filled, and the durability of the grindstone improves.

In the inner cutter according to the present invention, it is possible to cause the edges on the outer circumferential sides of the cutter blades to protrude in the direction of the reciprocating motion of the inner cutter and form the cutter rake angle in the protruded edges in an acute angle. With this structure, the cutter blades have greatly increased strength, and the cutting ability of the electric shaver improves.

Furthermore, in the inner cutter of the present invention, the cut-outs that open inwardly can be formed in the vicinity of the twisted portions which are between the cutter blades and the side edge portions. With this structure, the vibration of the cutter blades tends not to be transmitted to the side edge portions, and the transmission of vibration between one cutter blade to another can be suppressed. Accordingly, the sound quality during use can be controlled. For example, the sound quality can be can be controlled by varying the depth and width of the cut-outs. Furthermore, the vibrations and sound quality of the cutter blades can be varied by way of forming the inner circumferential edges of the cutter blades in a wave shape or varying the width of the cutter blades in the radial direction depending upon the positions of the cutter blades in the circumferential direction.

DETAILED DESCRIPTION OF THE INVENTION

Figure 1:
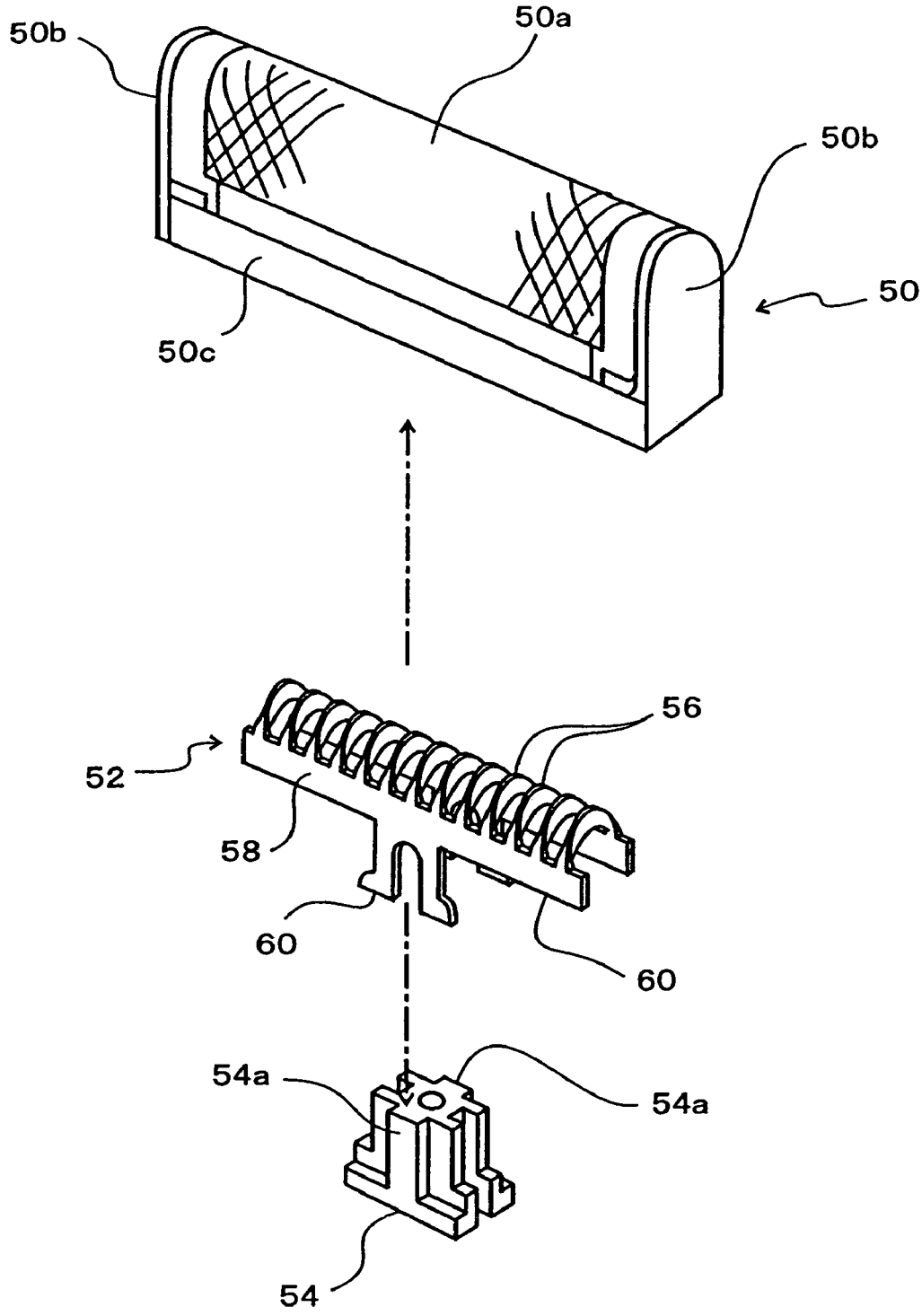
FIG. 1 is a perspective of an inner cutter according to one embodiment of the present invention shown together with a retaining base for the inner cutter and an outer cutter.
Figure 4:
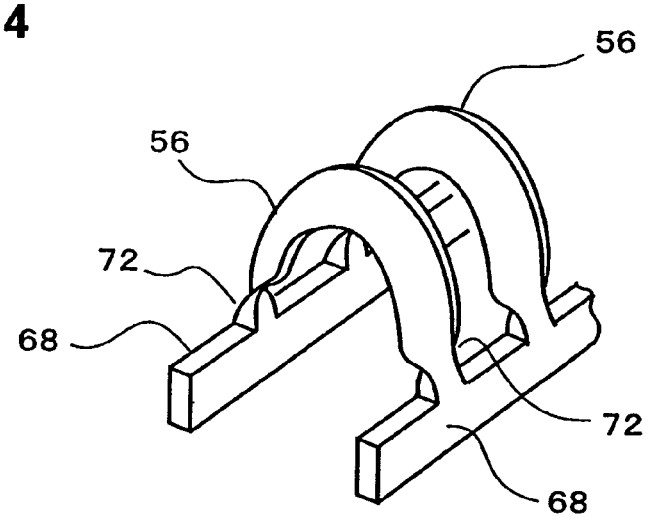
FIG. 4 is a partial enlarged view of the inner cutter of the present invention.
Figure 5:
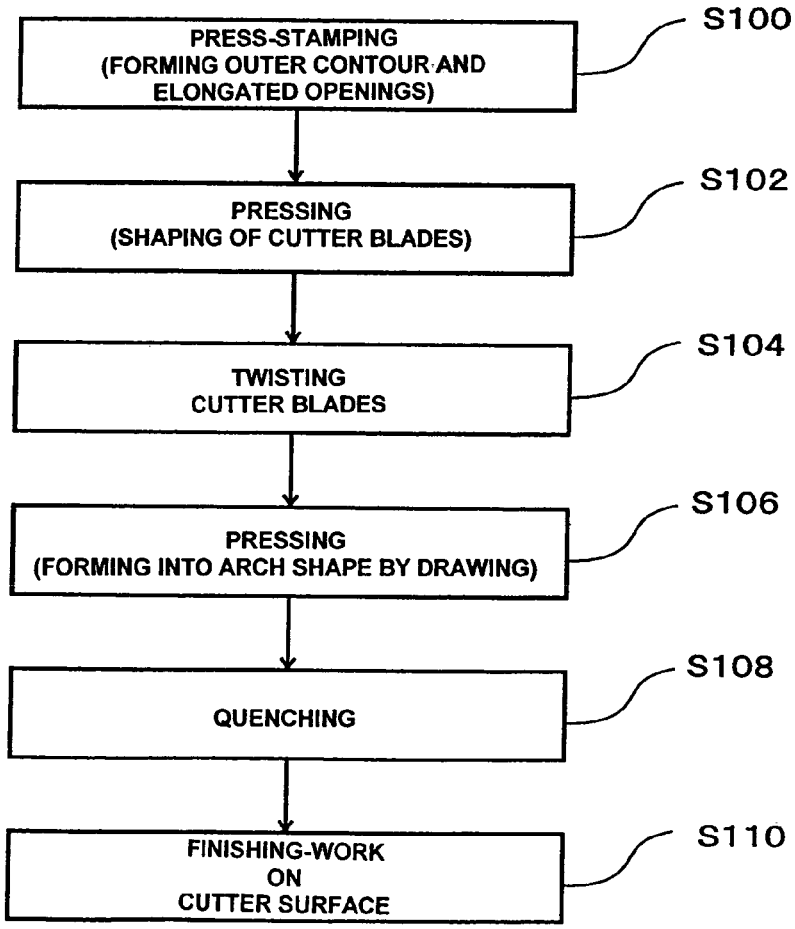
FIG. 5 shows the steps of the manufacturing process of the present invention.

FIG. 1 shows the inner and outer cutters of the reciprocating electric shaver according to one embodiment of the present invention. FIGS. 2A through 2D show the manufacturing steps of the inner cutter of the present invention. FIGS. 3A through 3E show the working process of the cutter blades of the inner cutter of the present invention. FIG. 4 shows a part of the inner cutter of the present invention. FIG. 5 is a flow chart of the manufacturing steps of the inner cutter of the present invention.

In FIG. 1, the reference numeral 50 is the outer cutter, 52 is the inner cutter, and 54 is a retaining base for the inner cutter 52.

In the outer cutter 50, an outer cutter body 50*a* made out of a thin metal plate is bent into an arch shape, and both ends in the direction of length of the outer cutter body 50*a* are closed off by cover plates 50*b*. In addition, both bottom edges of the outer cutter body 50*a* that are parallel to the direction of length of the outer cutter body 50*a* are held by side plates 50*c* (only one of which is shown) that are engaged with the cover plates 50*b* at both ends. A plurality of apertures that introduce hair are formed in the outer cutter body 50*a*.

As will be described in detail below, the inner cutter 52 is comprised of a plurality of arch-shaped cutter blades 56 that are formed integrally. The arch-shaped outer circumferential surface of each cutter blade 56 is a curved surface that makes sliding contact with the inside surface of the outer cutter body 50*a* of the outer cutter 50. In this inner cutter 52, bifurcated claws 60 protrude from the centers of both side edge portions 58 that are parallel to the direction of length (or the direction of reciprocating motion) of the inner cutter 52. These claws 60 engage with protruded portions 54*a* of the side surfaces of the retaining base 54.

The retaining base 54 engages with an oscillating body (not shown) that is driven in a reciprocating manner by a motor installed in the shaver and makes reciprocating motions together with the inner cutter 52. The retaining base 54 is urged toward the outer cutter 50 by a spring (not shown), so that the inner cutter 52 is elastically pressed against the inside surface of the outer cutter body 50*a*. The inner cutter 52 thus makes reciprocating motions while making sliding contact with the inside surface of the outer cutter body 50*a*.

Next, the method of manufacturing the inner cutter 52 will be described with reference to FIGS. 2A through 5.

Figure 2A:
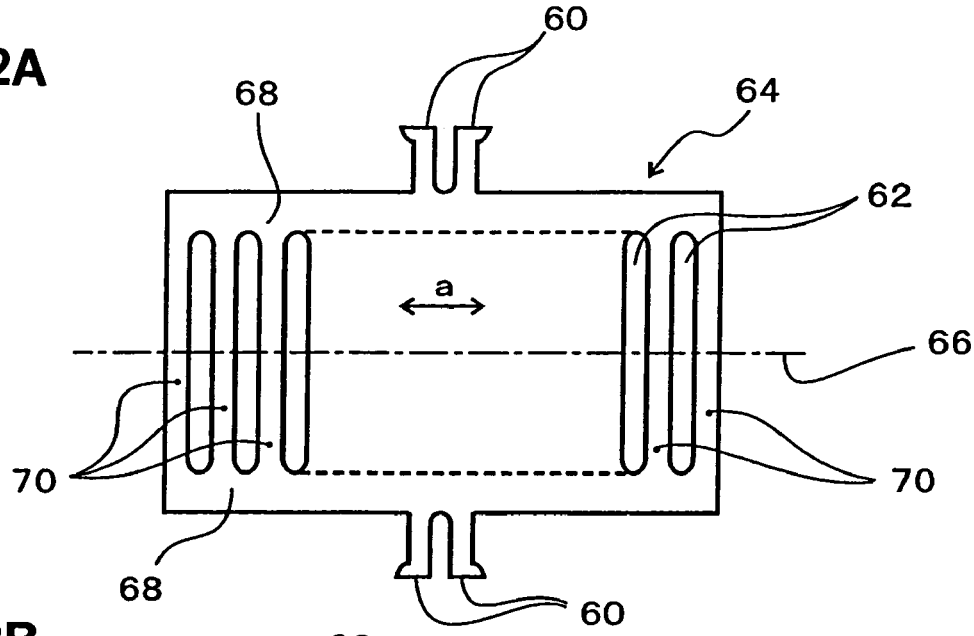
FIGS. 2A through 2D are diagrams that show the manufacturing process of the inner cutter of the present invention.
Figure 2B:
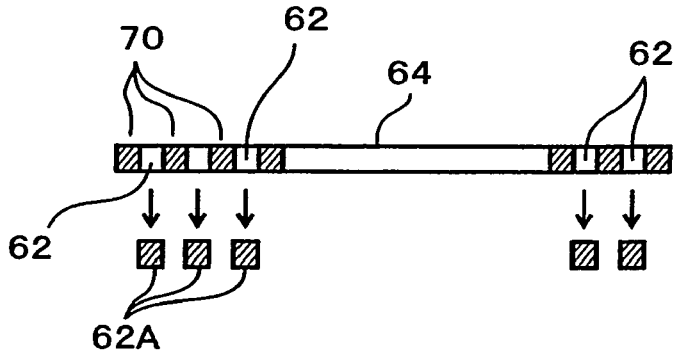

In the first step S100 (FIG. 5), a thin plate material that will make an inner cutter, e.g., a thin metal (stainless steel) plate that can be quenched, is prepared; and a thin metal plate element 64 is press-stamped from this thin metal plate as seen from FIG. 2A. The thin metal plate element 64 has an external contour of the unfolded shape of the inner cutter 52 and is formed with a plurality of elongated openings 62 that extend perpendicular to the direction of the reciprocating motion of the inner blade 52, such direction being shown by arrow a. FIG. 2A is a top view of the thin metal plate element 64, and FIG. 2B is a sectional view taken along the centerline 66 in FIG. 2A. In FIG. 2B, the reference numeral 62A indicates the waste material produced by the stamping operation of the elongated openings 62. In this press-stamping step, the above-described claws 60, side edge portions 68 that extend parallel to the direction a of the inner cutter's reciprocating motion, and bridging-portions 70 that are between two adjacent elongated openings 62 and connect the side edge portions 68 are formed in this thin metal plate element 64.

Figure 2C:
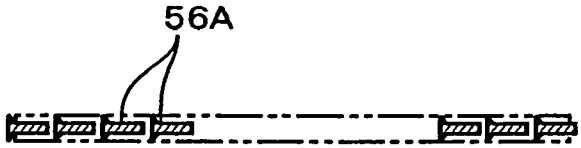
Figure 3A:
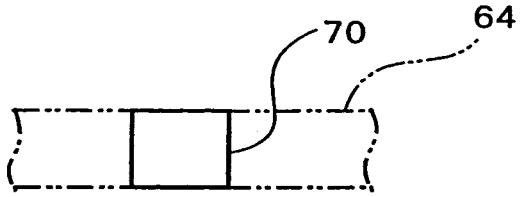
FIGS. 3A through 3E show in an enlarged view the working process of the cutter blades of the present invention.
Figure 3B:
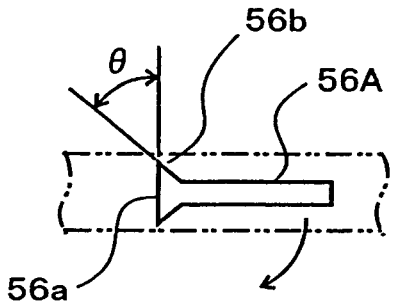
Figure 3C:
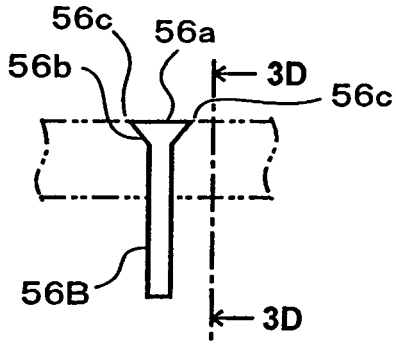

In the next step S102, the thus obtained thin metal plate element 64 is subjected to pressing or press-working as shown in FIG. 2C and further in FIG. 3B in detail. More specifically, by performing press-working on the bridging-portions 70 of the thin metal plate element 64, the bridging-portions 70 are deformed so that they have, in the direction parallel to the surface of the thin metal plate element 64 (or in substantially a horizontal direction as seen in FIG. 3C), a sectional shape of the final cutter blades 56. In other word, shaping of cutter blades is performed. Since the cutter blades shown in FIGS. 2C and 3B are still at an intermediate state of working and not yet completed as the cutter blade, such cutter blades in FIGS. 2C and 3B are referred to by the reference numeral 56A. These cutter blades 56A have, as seen from FIG. 2C, a shape in which the width in the horizontal direction (direction of reciprocating motion a or parallel to the surface of the thin metal plate element 64) is greater than the thickness of the thin metal plate element 64.

Furthermore, in these cutter blades 56A that are in an intermediate stage of the manufacturing process, one end (left end in FIG. 3B) of each one of the cutter blades 56A is formed so that it becomes larger in thickness toward the end surfaces (cutter surfaces) 56*a*, thus having a protruded edge 56*b* that is substantially in a triangular shape, and the rake angle θ of the protruded edge 56*b* is formed in an acute angle.

Figure 2D:
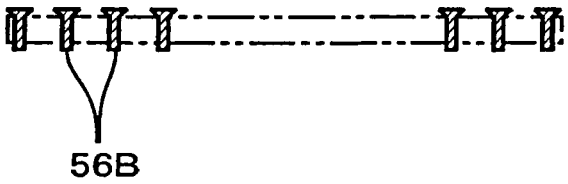

In the next step S104, these cutter blades 56A on which press-working have been done horizontally or in the direction perpendicular to the surface of the obtained thin metal plate element 64 (thus a cutter blade shaping has been completed) are twisted approximately 90°, so that the end surfaces (cutter surfaces) 56*a* of the cutter blades 56A on the protruded edge 56*b* sides are aligned to the plane (surface) of the thin metal plate element 64 as shown in FIGS. 2D and 3C. Such twisting can be accomplished by inserting a special jig (not shown) into the spaces between the cutter blades 56A from above and below and turning the cutter blades 56A in the direction shown by curved arrow in FIG. 3B so that the cutter surface 56*a* of the cutter blades are aligned substantially to the surface of the thin metal plate element 64. As a result, the horizontal cutter blades 56A in the horizontal direction or parallel to the plane (surface) of the thin metal plate element 64 as shown in FIGS. 2C and 3B are caused to stand up so as to be upright cutter blades 56B as shown in FIGS. 2D and 3C.

Figure 3D:
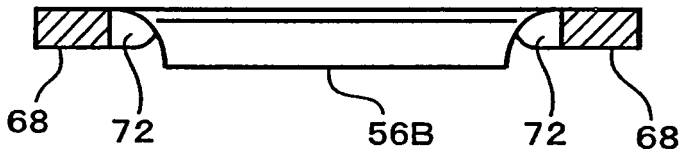

FIG. 3D is a sectional view along line 3D—3D in FIG. 3C. These cutter blades 56B have twisted portions 72 formed by twisting the bridging-portions 70 in the areas connected to side edge portions 68 (see FIGS. 2A and 2B and FIG. 3A). Since the twisted portions are formed by way of twisting portions of the thin metal plate element, they have great rigidity, and the cutter blades 56B are strongly joined to the side edge portions 68.

Figure 3E:
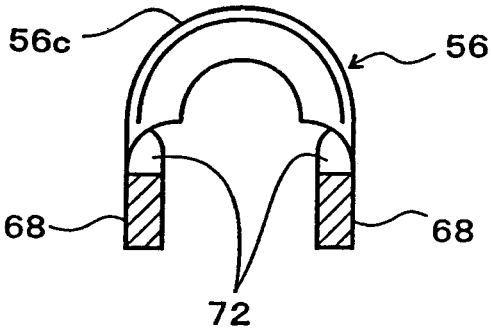

In the next step S106, the thin metal plate element 64 provided with the cutter blades 56B that are thus twisted and raised is, by for instance press-working or drawing, formed into an arch shape with the cutter surfaces 56*a* of the cutter blades 56B on the outside as shown in FIG. 3E. The drawing is performed so that, for instance, the lower ends of the cutter blades 56B (opposite edges from the cutter surfaces 56*a*) are wrapped while being pressed against a jig that has a cylindrical surface having a certain radius, and the side edge portions 68 are caused to face each other in a substantially parallel configuration.

The thin metal plate element 64 on which drawing is performed and formed into an arch shape is quenched in step S108, and in step S110 a finishing work is executed on the outer circumferential surfaces (cutter surfaces) 56*a* of the thin metal plate element 64. More specifically, the outer circumferential surfaces (cutter surfaces 56*a*) of the arch-shaped cutter blades 56 are polished. As a result of this polishing, the outer circumferential surfaces 56*a* of the respective cutter blades 56 form cutting edges 56*c* that extend in the form of eaves toward the adjacent cutter blades 56 with the rake angle θ of the cutting edges 56*c* (see FIGS. 3B and 3C) being in an acute angle, and the inner cutter 52 is finally obtained.

Figure 6A:
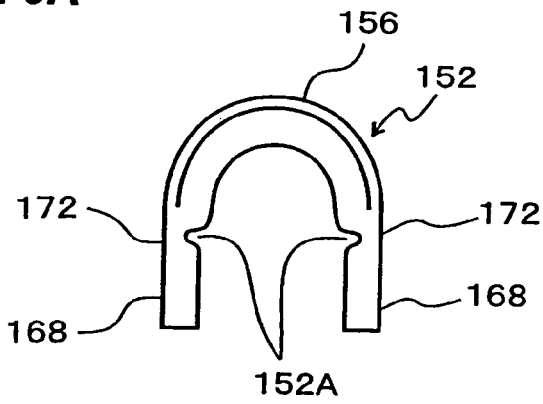
FIGS. 6A through 6C show other embodiments of the inner cutter.
Figure 6B:
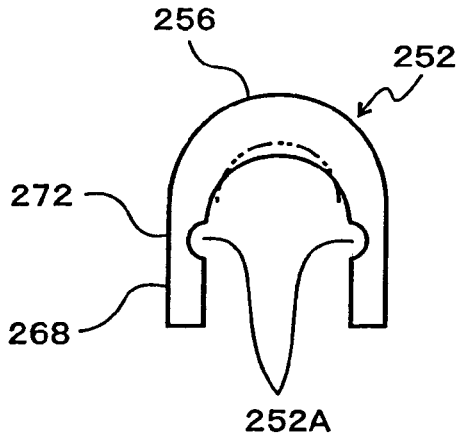
Figure 6C:
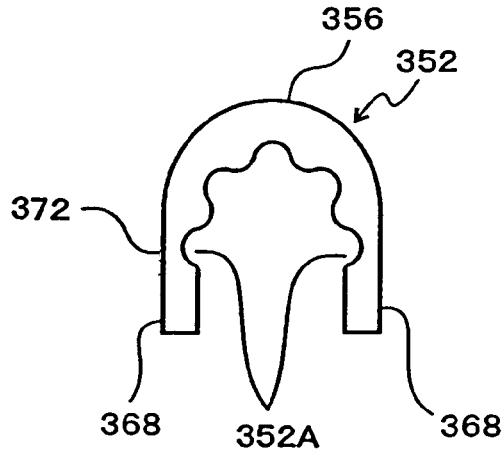
Figure 7:
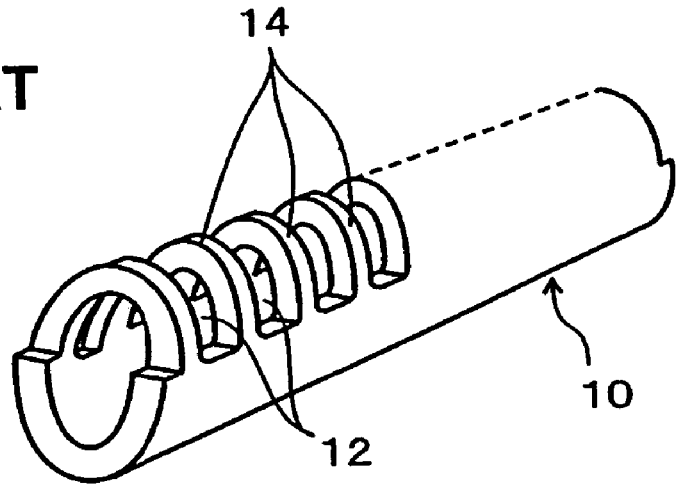
FIG. 7 PRIOR ART
FIG. 7 is a perspective view of one type of a prior art inner cutter.
Figure 8:
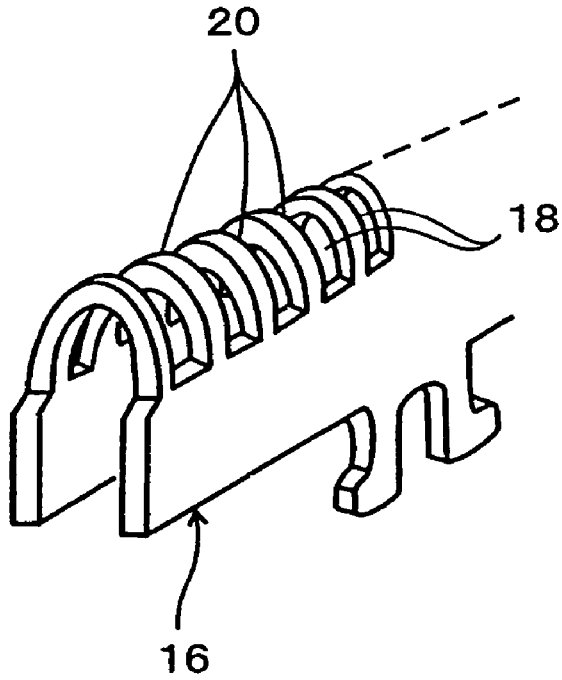
FIG. 8 PRIOR ART
FIG. 8 is a perspective view of another type of a prior art inner cutter.
Figure 9:
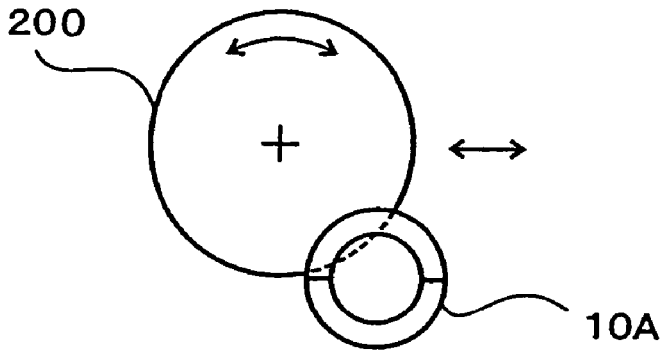
FIG. 9 PRIOR ART
FIG. 9 shows a prior art working method for an inner cutter.
Figure 10:
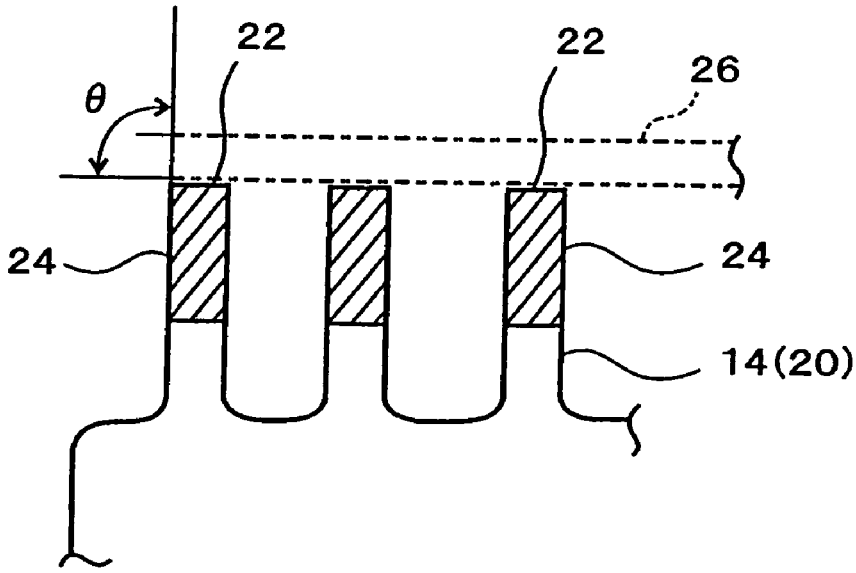
FIG. 10 PRIOR ART
FIG. 10 is a sectional view of an inner cutter manufactured by a conventional method.
Figure 11:
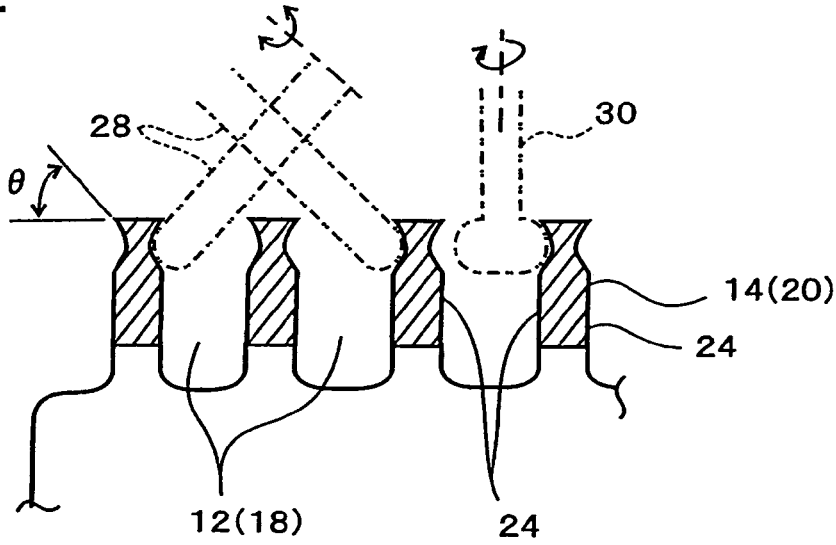
FIG. 11 PRIOR ART
FIG. 11 shows a prior art method for forming rake angles.
Figure 12:
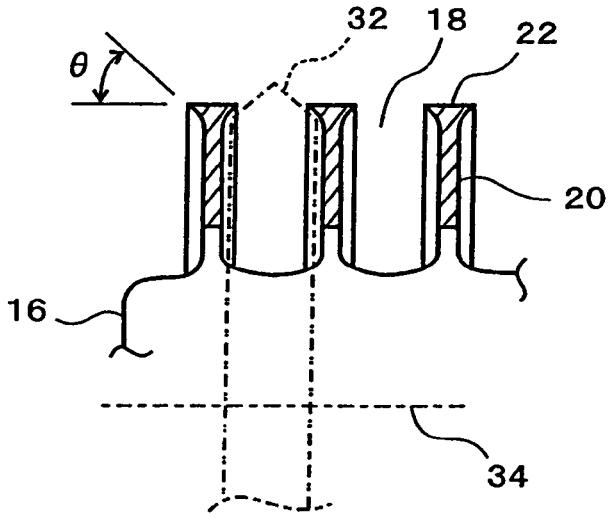
FIG. 12 PRIOR ART
FIG. 12 shows another prior art method for forming rake angles.

FIGS. 6A through 6C show the inner cutters according to other embodiments of the present invention.

In the inner cutter 152 shown in FIG. 6A, cut-outs 152A that open inwardly are formed in the twisted portions 172 that are formed by twisting the connecting portions between the cutter blades 156 and side edge portions 168. The cut-outs 152A are formed so that, for example, cuts are formed in both ends of the cutter blades 156 in the cutter blade shaping step S102 in FIG. 5, and these cuts result in forming the cut-outs 152A in the arch shape drawing step S106. In the inner cutter 152, since the transmission of vibration between the cutter blades 156 and side edge portions 168 can be suppressed by the cut-outs 152A, the sound arising from the use of the electric shaver can be controlled by appropriately setting the depth and size of the cut-outs.

In the inner cutter 252 shown in FIG. 6B, the width of the cutter blades 256 (width in the radial direction, vertical direction in FIG. 6B) is set so that it is larger near the center, and this width gradually becomes smaller in the circumferential direction toward the both ends. In this inner cutter 252, the width of the cutter blade 256 is larger in the vicinity of the center where vibration of the cutter blades is most likely to occur and a large external force is applied; accordingly, deformation caused by such an external force can be minimum, and the cutter blades 256 have high durability. Furthermore, the structure provides an improved sound quality. In FIG. 6B, the reference numeral 268 is the side edge portions, 272 indicates the twisted portions, and 252A are the cut-outs.

In the inner cutter 352 shown in FIG. 6C, the inner circumferential edges of the cutter blades 356 are formed into a wave shape. The thus designed cutter blades 356 are ideal for improving the sound quality by suppressing vibration of the cutter blades 356. In FIG. 6C, the reference numerals 368 are the side edge portions, 372 indicates the twisted portions, and 352A are the cut-outs.

The invention claimed is:

1. A method for manufacturing an inner cutter for a reciprocating electric shaver, said inner cutter being caused to make a reciprocating motion while a plurality of arch-shaped cutter blades disposed on said inner cutter are caused to make sliding contact with an inside surface of an arch-shaped outer cutter, said method comprising the ordered steps of:

(a) press-stamping a flexible thin metal plate to obtain a thin metal plate element that has an outer contour of an unfolded shape of said inner cutter and a plurality of elongated openings that extend substantially perpendicular to a direction of a reciprocating motion of said inner cutter, thus forming a plurality of substantially straight bridging-portions between said plurality of elongated openings;

(b) pressing said plurality of bridging-portions of said press-stamped thin metal plate element so that each of said plurality of bridging-portions has a final sectional shape of each of said cutter blades in a direction substantially parallel to a plane surface of said thin metal plate element;

(c) twisting each of said plurality of bridging-portions while said thin metal plate element lies in said plane surface so that cutter surfaces of said cutter blades are aligned substantially to said plane surface of said thin metal plate element;

(d) forming said thin metal plate element into substantially an arch shape with said cutter surfaces of said cutter blades facing outward; and (e) executing finishing-work on an outer circumferential surface of said arch-shaped thin metal plate element.

2. The method for manufacturing an inner cutter for a reciprocating electric shaver according to claim 1, wherein a rake angle of said final sectional shape of said cutter blades worked by said pressing step (b) is an acute angle, said rake angle being formed at edges on said cutter surfaces of said cutter blades in said pressing step.

3. The method for manufacturing an inner cutter for a reciprocating electric shaver according to claim 2, wherein said cutter blades worked it said pressing step (b) has a width that is greater than a thickness of said thin metal plate element press-stamped in said press-stamping step (a).

4. The method for manufacturing an inner cutter for a reciprocating electric shaver according to claim 2, wherein said pressing step (b) further forms cuts in the vicinity of edge areas of said plurality of bridging-portions, said cuts being arranged so as to form cut-outs that open inwardly on inner circumferential edges of said cutter blades.

5. The method for manufacturing an inner cutter for a reciprocating electric shaver according to claim 1, wherein said cutter blades worked in said pressing step (b) has a width that is greater than a thickness of said thin metal plate element press-stamped in said press-stamping step (a).

6. The method for manufacturing an inner cutter for a reciprocating electric shaver according to claim 1, wherein said twisting step (c) twists said plurality of bridging-portions by approximately 90 degrees with respect to said plane surface of said thin metal plate element.

7. The method for manufacturing an inner cutter for a reciprocating electric shaver according to claim 1, wherein said finishing-work step (e) grinds said outer circumferential surface after quenching said thin metal plate element.

8. A method for manufacturing an inner cutter for a reciprocating electric shaver, said inner cutter being caused to make a reciprocating motion while a plurality of arch-shaped cutter blades disposed on said inner cutter are caused to make sliding contact with an inside surface of an arch-shaped outer cutter, said method comprising the steps of:

(a) press-stamping a thin metal plate to obtain a thin metal plate element that has an outer contour of an unfolded shape of said inner cutter and a plurality of elongated openings that extend substantially perpendicular to a direction of a reciprocating motion of said inner cutter, thus forming a plurality of bridging-portions between said plurality of elongated openings;

(b) pressing said bridging-portions of said press-stamped thin metal plate element so that each of said bridging-portions has a final sectional shape of each of said cutter blades in a direction substantially parallel to a surface of said thin metal plate element;

(c) twisting said bridging-portions so that cutter surfaces of said cutter blades are aligned substantially to said surface of said thin metal plate element;

(d) forming said thin metal plate element into substantially an arch shape with said cutter surfaces of said cutter blades facing outward; and (e) executing finishing-work on an outer circumferential surface of said arch-shaped thin metal plate element;

wherein said pressing step (b) further forms cuts in the vicinity of edge areas of said plurality of bridging-portions, said cuts being arranged so as to form cut-outs that open inwardly on inner circumferential edges of said cutter blades.

* * * * *